United States Patent [19]

McDermott

[11] Patent Number: 5,050,053

[45] Date of Patent: Sep. 17, 1991

[54] FLASHLIGHT OF SELECTABLE COLORS

[76] Inventor: Kevin McDermott, 196 Philillips Dr., Hampstead, Md. 21074

[21] Appl. No.: 580,572

[22] Filed: Sep. 11, 1990

[51] Int. Cl.[5] ..... F21L 7/00

[52] U.S. Cl. ..... 362/204; 362/206; 362/118; 362/186; 362/293; 200/60

[58] Field of Search ..... 362/109, 118, 158, 189, 362/204, 205, 206, 208, 186, 293; 200/60

[56] References Cited

U.S. PATENT DOCUMENTS

| | | | |
|---|---|---|---|
| 2,522,660 | 9/1950 | Bledsoe, Jr. | 362/189 |
| 2,818,499 | 12/1957 | Moore | 240/10.68 |
| 3,579,269 | 5/1971 | Ostersen | 362/158 |
| 3,717,759 | 2/1973 | Rousseau | 200/60 |
| 4,225,907 | 9/1980 | Erdell | 362/118 |
| 4,484,253 | 11/1984 | Roberts | 200/60 |
| 4,495,551 | 1/1985 | Foltz | 200/60 |
| 4,516,194 | 5/1985 | Johns | 362/206 |
| 4,517,628 | 5/1985 | McDermott | 362/186 |
| 4,631,646 | 12/1986 | Spindler | 362/189 |
| 4,768,138 | 8/1988 | Leopoldi et al. | 362/189 |

*Primary Examiner*—Ira S. Lazarus
*Assistant Examiner*—D. M. Cox
*Attorney, Agent, or Firm*—Eugene F. Osborne, Sr.

[57] ABSTRACT

A battery powered pocket flashlight has a noncorrosive and electrically nonconductive case containing a restrictive aperture for the projection of light from the lamp source and a resilient color filter attached externally upon the end of the case by integral stub axles extending inward into the case for an axis of rotation intersecting perpendicular to the longitudinal axis of the flashlight for operation by the user in the selection of unfiltered light of the lamp source or a light at a color of the visible spectrum of colors. The filter is secured to the case by resilience of the filter material and by its shape in the form of an acute sector of a sphere. The electrical sub-system is completely removable from the case for servicing. The flashlight is controlled by compression of a conical helical spring conductor having coiled turns that collapse under compression upon the negative return surface of the battery for switching current to the lamp bulb through a one piece conductor that includes the switching helical spring plus a conductor extending past the batteries to an integral holder for the lamp bulb. A nonconducting pocket clip and combined switch actuator is movable axially to the case for compression of the helical switching spring.

11 Claims, 8 Drawing Sheets

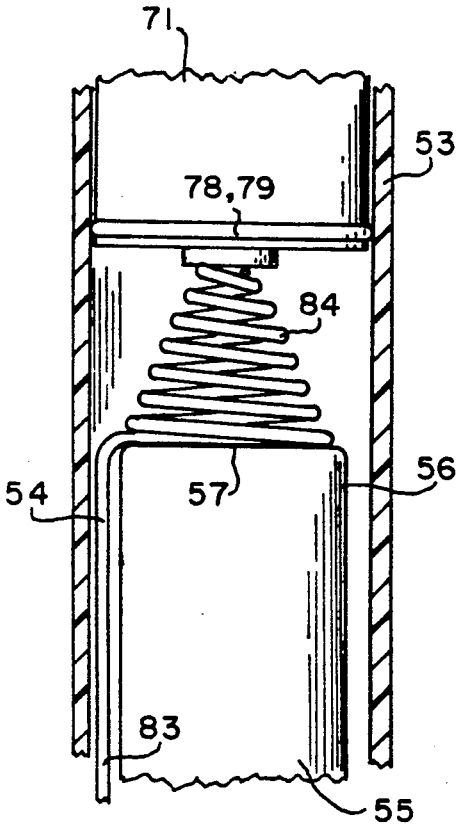
FIG.36
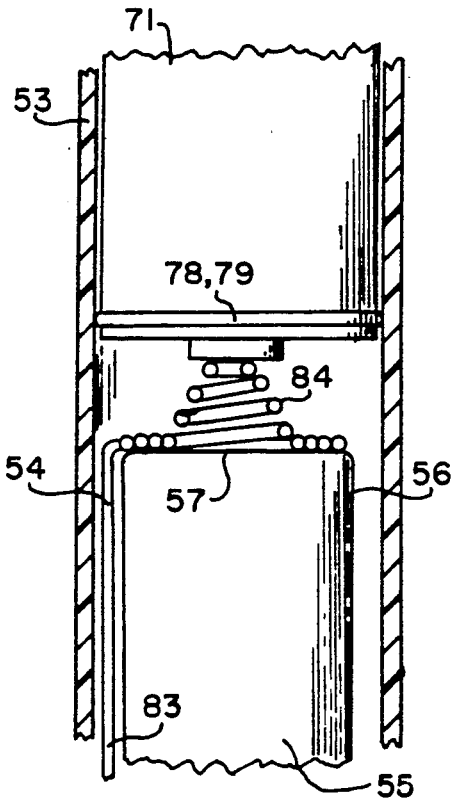
FIG.37
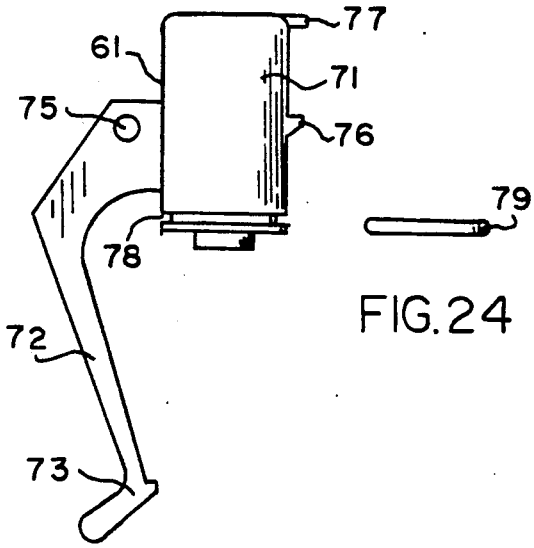
FIG.22
FIG.24
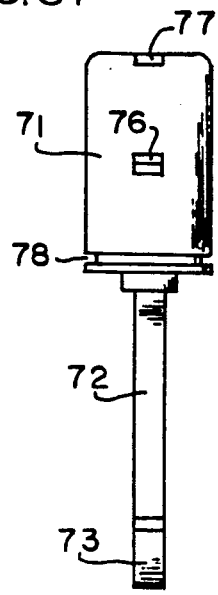
FIG.23
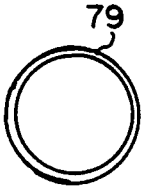
FIG.25

FLASHLIGHT OF SELECTABLE COLORS

BACKGROUND OF THE INVENTION

1. Field of the Invention

This invention, in the preferred embodiment, relates to battery powered hand held lamps, commonly known as flashlights, or when in compact form as pen or pocket lights. More specifically, the invention relates to quasi-blackout applications and uses that require fast visual recovery in darkness and minimum personal exposure of the operator of the device.

For example, the use of high intensity white light reflected from white papers, such as maps or writing pads, adversely affects the eyes and could influence vehicular or other accidents, if the viewer was subsequently required to make a fast judgment in another field of view where the illumination levels were then low. This invention assists in avoidance of such hazards by confining the light beam and by making it convenient to quickly select a white light or a colored light, such as red, from the hand held lamp.

As illustrated and described herein, the invention is applied to a cylindrical flashlight of the penlight type. Broader applications of the principles and features disclosed include uses in varied lighting apparatus where a convenient and rapid change in color of the illumination is required. Features and techniques disclosed reduce the costs of manufacture and assembly and improve operating reliability.

2. Related Prior Art

Portable lighting devices such as flashlights and compact hand lamps of the cylindrical penlight variety are well known in the art. Typical of the art for such devices is a U.S. Pat. No. 2,818,499 (Moore) that discloses a penlight having a tubular casing with a bulb holder, assembled in one end of the tube, a switching mechanism in the opposite end of the tube, and means for holding the dry cell batteries in fixed positions. U.S. Pat. No. 4,516,628 (McDermott) discloses a dual color penlight which has its color changed by rotating a component along the axis of the flashlight.

SUMMARY OF INVENTION

The present invention comprises a tubular casing for housing a battery and lamp with improvements in the switching mechanism, color filter mechanism and pocket clip design. The invention achieves these objectives with a minimum of components by combining the functions of various components. In addition, the invention is economical to produce because it does not require complex molding processes or accurate tolerances. The reliability is also improved because the reduced number of serial contact points and enlarged surface area of the switching contact mechanism reduces the possibility of failure through high circuit resistance.

One objective of this invention is to create a flashlight which is brighter and more efficient because it has fewer electrical contact points than prior designs.

Another objective of this invention is to produce a less expensive and more reliable flashlight by reducing the number of components.

Another objective of this invention is to produce a flashlight which is easy to maintain because the battery, bulb and switch contact can be checked for operation outside of the flashlight.

Another objective of this invention is to provide a flashlight that is more reliable because the switch contact makes contact at several parallel points and eliminates the failure that would occur in previous designs when nonconductive elements found their way between the single point switch contact.

Another objective of this invention is to provide a flashlight that can have its color easily changed by the one holding hand because the filter rotates about an axle perpendicular to the longitudinal axis of the tubular body.

Another objective of this invention is to create a flashlight which incorporates a switch that can be water resistant with an O-ring design.

Another objective of this invention is to create a flashlight that incorporates the switch actuator and pocket clip into a single component.

Another objective of this invention is to produce a flashlight that automatically turns off as the pocket clip is flexed for use.

Another objective of this invention is to produce a flashlight that has a noncorrosive, nonconductive body.

Another objective of this invention is to design a flashlight that incorporates a tubular plastic body that is economical to produce because it does not require a cam action mold.

Another objective of this invention is to create a flashlight that can easily have its color changed by moving an integral color filter into position over the bulb.

Another objective of this invention is to incorporate a color filter that does not need a protective cover because it is constructed of a flexible elastomeric material for flexibility to distort and be snapped onto the body of the flashlight.

Another objective of this invention is to provide a color filter with a curvilinear shape with resilience to grip the body of the flashlight while simultaneously matching the interior curve of the filter to the contour of the flashlight for providing a light seal between the color filter and flashlight body.

BRIEF DESCRIPTION OF DRAWINGS

Other objects and advantages may be observed from the description when viewed in conjunction with the accompanying drawings wherein:

FIG. 22 is the side view of the pocket clip/switch shown in FIG. 21.

FIG. 23 is a front view of the pocket clip/switch shown in FIG. 21.

FIG. 24 is a side view of the O-ring which is optional placed on the pocket clip/switch.

FIG. 25 is a top view of the FIG. 24 O-ring.

FIG. 36 is a sectional view through the flashlight with the switch in the "OFF" position. This section is taken along line I—I of FIG. 18.

FIG. 37 is a sectional view through the flashlight with the switch in the "ON" position. This section is taken along line J—J of FIG. 19.

DETAILED DESCRIPTION OF THE INVENTION

Figure 3:
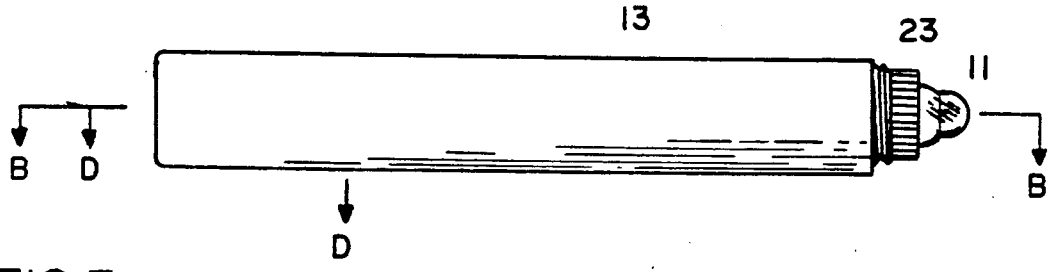
FIG. 3 is an elevation view of the flashlight with a conductive outer tube and the switch in the "OFF" position.
Figure 1:
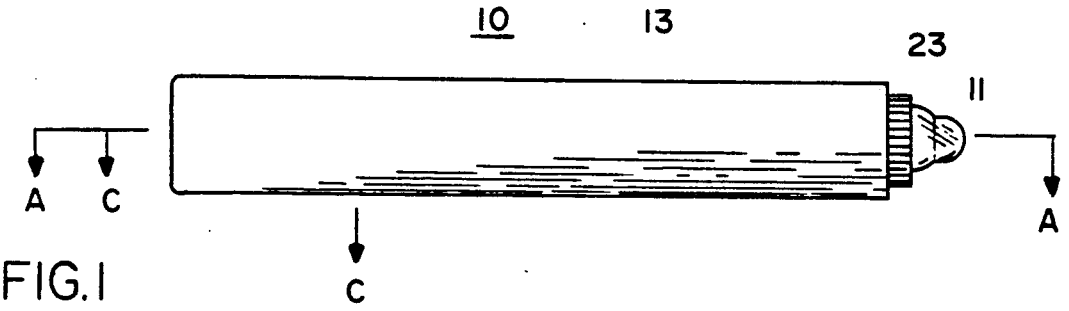
FIG. 1 is an elevation view of the flashlight with a conductive outer tube and the switch in the "ON" position.
Figure 4:
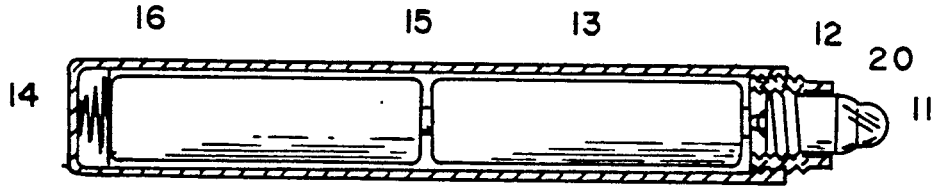
FIG. 4 is a sectional view through the flashlight taken along B—B of FIG. 3.
Figure 2:
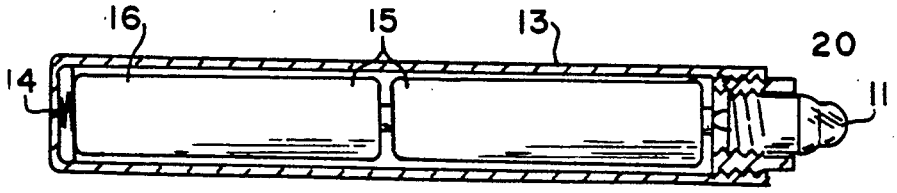
FIG. 2 is a sectional view through the flashlight taken along A—A of FIG. 1.
Figure 8:
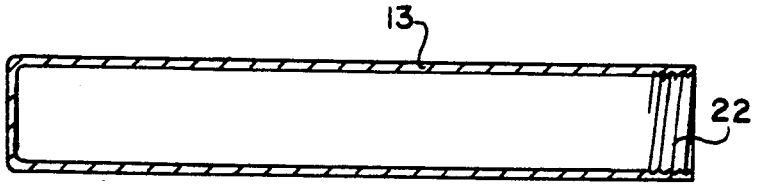
FIG. 8 is a sectional view of the tube of the flashlight shown in FIG. 4.
Figure 7:
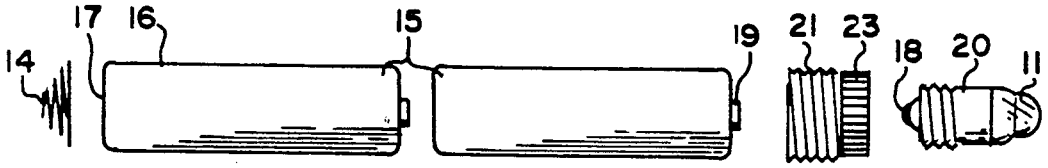
FIG. 7 is an exploded illustration of the internal components of the flashlight shown in FIG. 4.
Figure 6:
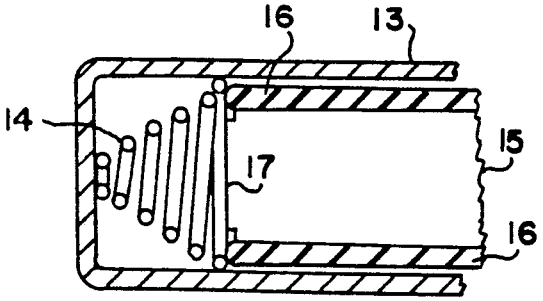
FIG. 6 is a sectional view of the switch of the flashlight in the "OFF" position taken along line D—D of FIG. 3.
Figure 40:
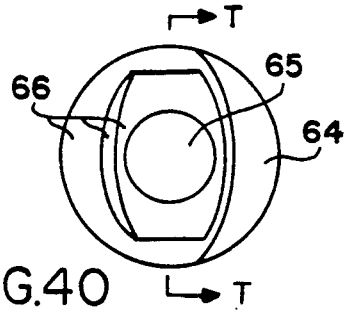
FIG. 40 is an elevation view of the front of the flashlight case shown in FIG. 26, having the color filter removed.
Figure 41:
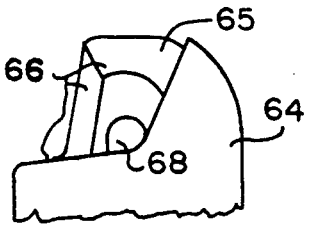
FIG. 41 is a side elevation view of the front of the flashlight case illustrated in FIG. 40 where the color filter is removed.
Figure 5:
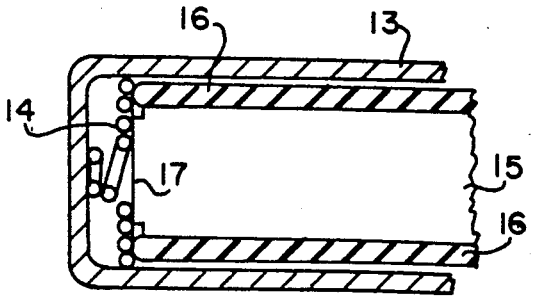
FIG. 5 is a sectional view through the switch of the flashlight in the "ON" position taken along line C—C of FIG. 1.
Figure 42:
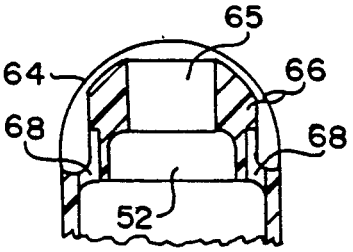
FIG. 42 is a sectional view of the front of the flashlight case taken on line T—T of FIG. 40.
Figure 9:
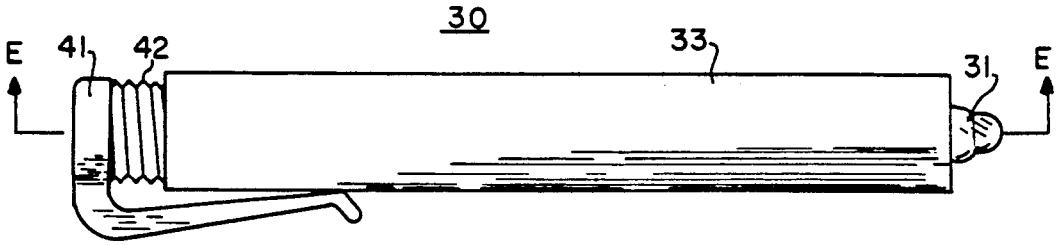
FIG. 9 is an elevation view of a first alternate flashlight with its pocket clip/switch in the "OFF" position.
Figure 11:
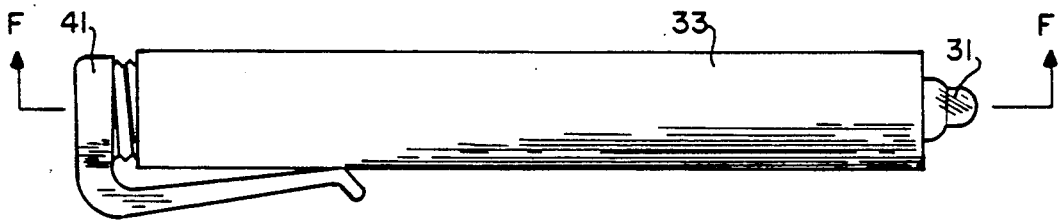
FIG. 11 is an elevation view of a first alternate flashlight with its pocket clip/switch in the "ON" position.

Now in reference to the drawings an improved penlamp flashlight design 10 is illustrated in FIGS. 1-8. An incandescent lamp 11 is retained in a movable socket 12 which may be reciprocally advanced in or out along the longitudinal axis of the conducting tubular flashlight case 13. This motion of the lamp 11 and socket 12 is further translated by the dry cell batteries 15 within the case 13 to effect compression of the helical coiled conducting spring 14 which is captured within the closed end of the case 13. The helical spring 14 has multiple turns of decreasing diameters as shown most clearly in FIG. 6 where the largest diameter abuts the insulated casing 16 of the battery 15 and the smallest diameter is in contact with inner conducting surface of the case 13. With inward motion of the combination of the lamp 11, the socket 12, and the batteries 15 successive turns of the conical coiled helical spring 14 are collapsed upon the conducting negative base 17 of the battery 15. Thus with the lamp terminal 18 in contact with the positive post 19 of the battery 15, an electrical circuit is completed from the battery base 17 through multiple turns of the spring 14 (See FIGS. 1, 2, and 5) to the conducting case 13, thence through the conducting socket 12 to the base 20 of the lamp 11. FIGS. 2, 4, and 7 illustrate a lamp 11 having a screw type base 20, however the concept is equally applicable to lamps having bayonet type configurations. Matching male 21 and female 22 threads are provided for the lamp socket 12 and the conducting case 13. The user, by rotating the socket 12 through its knurled surface 23 effects the motion to compress the helical spring 14 to turn the flashlight 10 "ON" or "OFF." Two hands are required to operate the flashlight.

Figure 10:
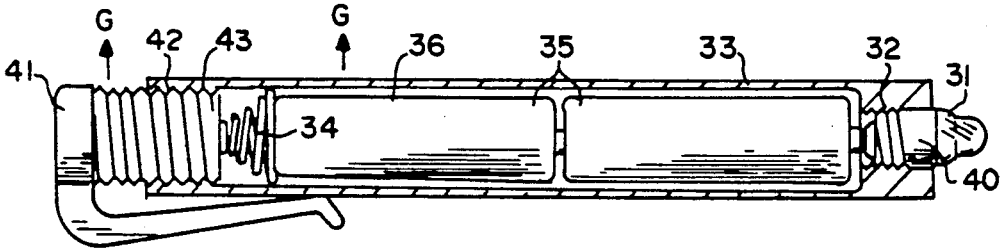
FIG. 10 is a sectional view through the flashlight taken along line E—E of FIG. 9.
Figure 12:
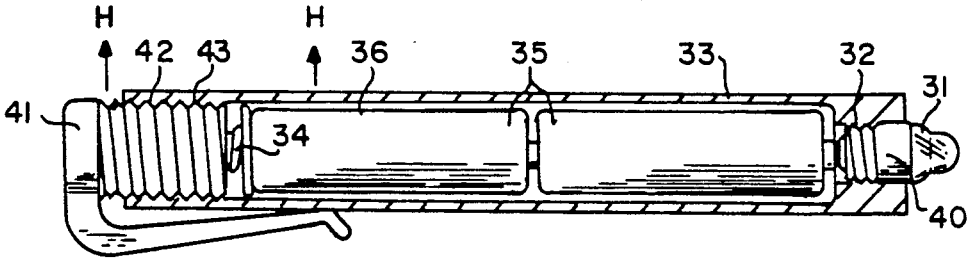
FIG. 12 is a sectional view through the flashlight taken along line F—F of FIG. 10.
Figure 14:
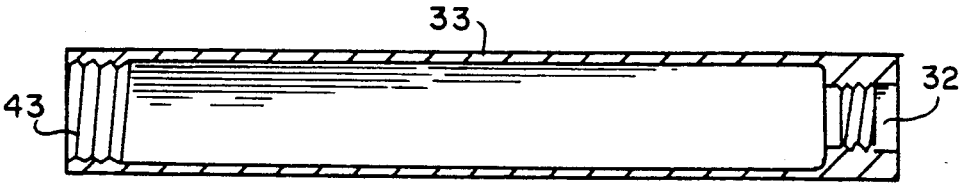
FIG. 14 is a sectional view of the tube of the flashlight shown in FIG. 10.
Figure 13:
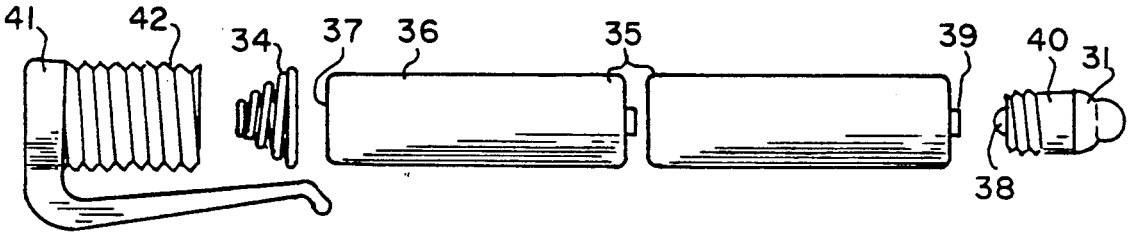
FIG. 13 is an exploded illustration of the internal components of the flashlight shown in FIG. 10.
Figure 15:
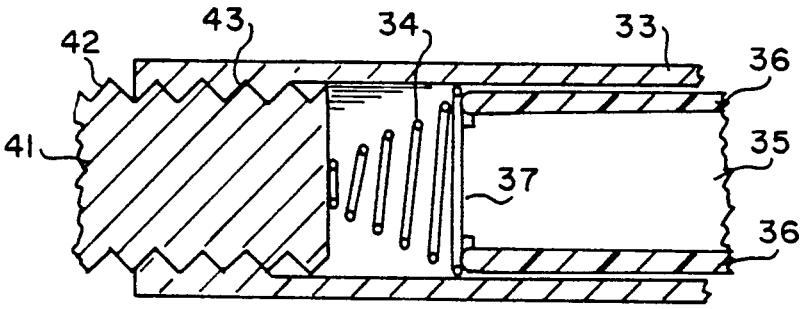
FIG. 15 is a sectional view of the switch section of the flashlight in the "OFF" position taken along line G—G of FIG. 10.
Figure 16:
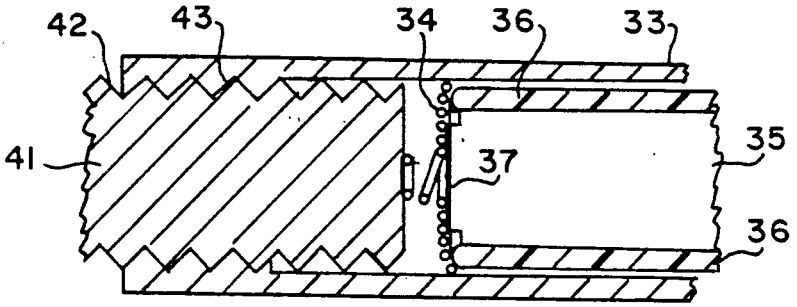
FIG. 16 is a sectional view of the switch section of the flashlight in the "ON" position taken along line H—H of FIG. 12.
Figure 17:
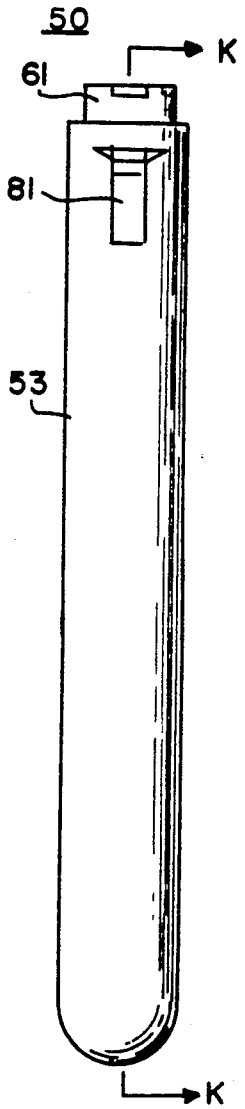
FIG. 17 is an elevation view of a second alternate flashlight in which the slot for retaining the pocket clip is shown.

Another improvement in penlamp flashlight design is illustrated in the drawings of FIGS. 9-16 where the lamp bulb 31 is assembled in a fixed receptacle 32 of the conducting case 33, FIG. 10 and 12. The batteries 35 are inserted from the rear end of the case 33 followed by the conically coiled helical spring 34 and user's one piece integrated control plug and pocket clip 41. As previously described with relation to FIG. 6 the coiled turn having the largest diameter of the spring 34 abuts the insulated cover 36 of the adjacent battery 35 and the coil of smallest diameter contacts the adjacent surface of the control and pocket clip 41. Matching male threads 42 and female threads 43 are provided for the one piece control plug and pocket clip 41 and for the conductive case 33 respectively so that relative rotation of the parts (41 and 33) by the user will compress or reciprocally relax the helical spring 34. Inward motion of the plug 41 in compressing the spring 34 collapses successive conducting coils of smaller and smaller diameter upon the conducting negative base 37 of the adjacent battery 35, FIGS. 11, 12, and 16. Since the lamp terminal 38 is in contact with the positive post terminal 39 of the battery 35 a conducting electrical circuit is completed from the battery base 37, through multiple turns of the spring 34, thence through the conducting one piece control plug and clip 41 and the conducting case 33 to the lamp base 40 for turning the lamp bulb 31 "ON." If the user reverses the relative rotations of the case 33 and the one-piece control plug and clip 41 the successive coiled turns of the spring 34 are recovered from contact, one-by-one, from the negative battery base 37 to open the electrical circuit and extinguish the lamp bulb 31, FIGS. 9, 10, and 15.

Figure 33:
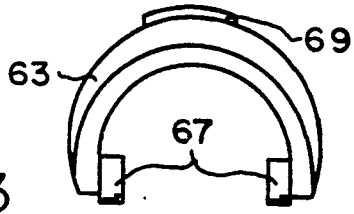
FIG. 33 is an elevation view of the color filter seen at the front of the flashlight in FIG. 18.
Figure 34:
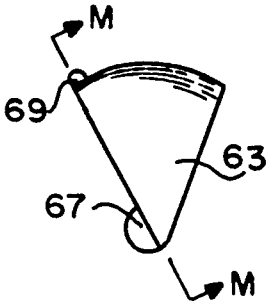
FIG. 34 is a side view of the FIG. 33 color filter.
Figure 35:
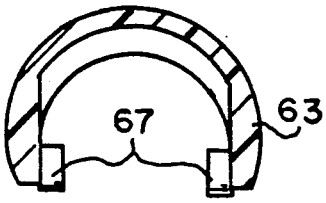
FIG. 35 is a sectional view of the color filter taken along line M—M of FIG. 34.
Figure 38:
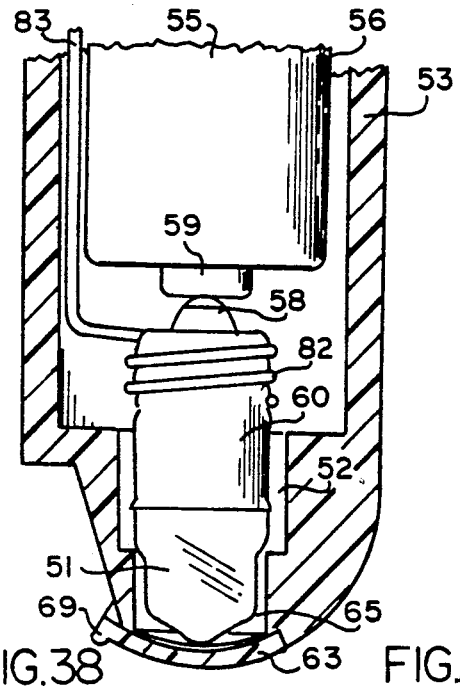
FIG. 38 is an expanded illustration of the front of the flashlight from FIG. 20 showing the filter in place for projecting colored light.
Figure 31:
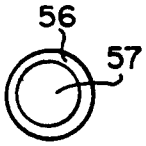
FIG. 31 is an end view of the FIG. 30 battery.
Figure 29:
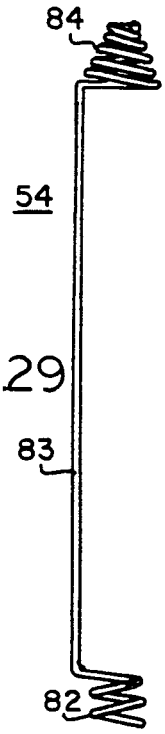
FIG. 29 is an elevation view of the switch spring with a longitudinal element and lamp socket removed from the FIG. 28 assembly.
Figure 30:
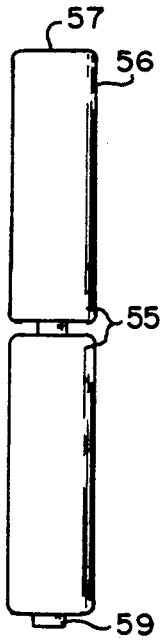
FIG. 30 is an elevation view of the battery removed from the FIG. 28 assembly.

The preferred embodiment of the improved flashlight 50 is illustrated in the drawings of FIGS. 17–39. In this embodiment provisions are incorporated for changing the color of the projected beam of light, at the option of the user, from the color emitted by an incandescent filament to a discrete color of the visible spectrum such as red, for example. As illustrated in FIGS. 17–21 and 27 the flashlight 50 is assembled in an opaque nonconducting cylindrical case 53 which may be made of plastic materials which may also have thermal insulating qualities by a process that does not require a cam action mold. At one end of the case 53, ordinarily referred to as the front end 64 of the flashlight 50, the case 53 has an internal retaining cavity 52 for holding the incandescent bulb 51. The front end 64 contains an aperture 65 centered on the longitudinal axis of the case 53 through which the light beam is projected. The front end 64 has a truncated and shaped curvilinear exterior surface 66 having contours, FIGS. 19–21, 27 and 38–42, for receiving thereupon a reversible rotatable color filter 63 which may be operated by the user in-and-out of the projected light beam to select either unfiltered incandescent light or a filtered light in the visible spectrum of colors, typically red although other colors might be obtained by appropriate filters 63. The color filter 63 is shaped with matching contours for overlaying upon the front end surface 66. The filter 63 is molded of a tough flexible material that permits it to distort so that its axle pins 67 can snap into the bearings 68. Rotation of the filter 63 is about a transverse axis that intercepts and is perpendicular to the longitudinal axis of the flashlight case 53. Opposing stub axle pins 67 of the filter 63 rotate in recessed bearings 68 in the surface 66 of the case 53. The filter 63 has a projecting lip 69 at its rearward edge to which the user applies thumb pressure for torque to cause reciprocal rotation of the filter to effect the color change while holding the flashlight with one hand, FIGS. 33–35.

At the second end 70 of the flashlight case 53, ordinarily referred to as the rear end of the flashlight 50, provisions are made for receiving a reciprocally operable integrated one-piece on-off push button and pocket clip controller 61, FIGS. 17–23, which has multiple purposes to hold the flashlight 50 assembly together, to actuate the projection of light by closing the electrical circuit to the lamp 51, and for secure carrying of the flashlight 50 in the user's pocket or for carrying by a lanyard. The push button and clip 61 is a molded electrically nonconducting plastic element having a basic cylindrical body 71 of appropriate diameter for insertion within the second end 70 of the flashlight case 53 from which a resilient flexible arm 72 projects radially to extend longitudinally along the flashlight case 53 to form the pocket clip. The arm 72 terminates at an offset angle with a heel-like projection 73 that latches upon a projecting switch retainer 74 that is an integral portion of the case 53 to secure the flashlight 50 in the turned on light projecting mode. The base of the arm 72 has a lanyard receiver 75. Diametrically opposed to the arm 72 upon the cylindrical body 71 are two protruding bosses, one located about midway along the body 71 being a retaining boss 76 for securing the one-piece pocket clip and push button 61 within the flashlight case. The second boss 77 protrudes radially from the end surface of the cylindrical body 71 where thumb pressure may be applied by the user to remove the clip and button 61 from the case 53 for disassembly of the flashlight 50. Adjacent to the inner end of the cylindrical body 71 a circumferential groove 78 is provided for placing therein an O-ring 79 for closing the flashlight case 53 against entry of foreign particles and for making the flashlight 50 water resistant.

To receive the one-piece clip and push button 61 within the case 53 an open slot 80 extends from the rear end 70 of the case 53 to the switch retainer 74. The length of the open slot 80 allows reciprocal in-and-out motion of the push button cylindrical body 71 within the case 53 and its open end allows removal of the body 71 for servicing the flashlight 50. Diametrically opposite to the open slot 80 a closed slot 81 is provided in the case 53 to receive the retaining boss 76 that projects midway from the cylindrical body 71. The closed slot 81 is of sufficient length to permit the in-and-out motion of the cylindrical body 71 for turning the flashlight 50 on-and-off. When thumb pressure is applied to the second boss 77 at the end surface of the body 71 the case 53 flexes slightly at the open slot 80 allowing the retaining boss 76 to pass in-and-out of the closed slot 81 for servicing the flashlight 50.

Figure 21:
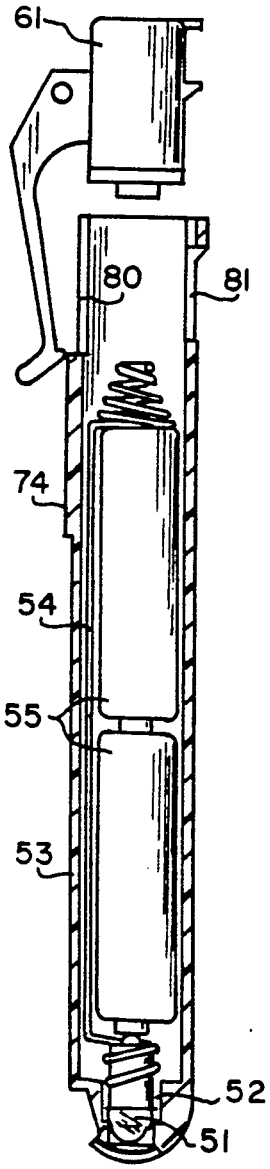
FIG. 21 is similar to FIG. 20 except that the pocket clip has been removed completely from the tube.
Figure 27:
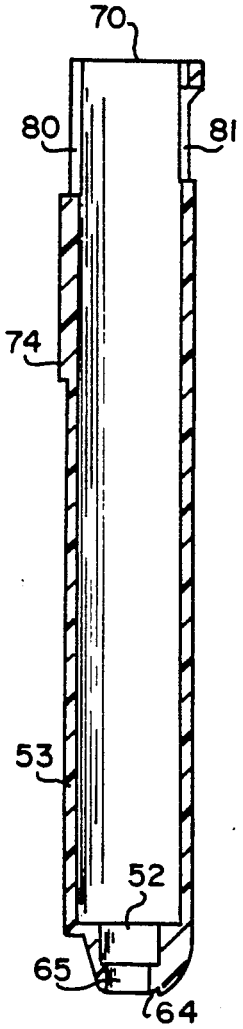
FIG. 27 is a sectional view of the flashlight tube taken along line L—L of FIG. 26.
Figure 26:
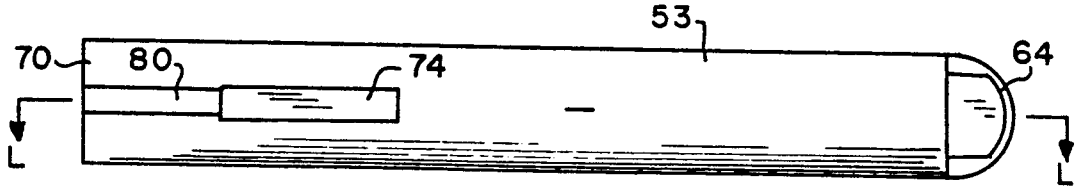
FIG. 26 is a front view of the tube only of the FIG. 17 flashlight.
Figure 18:
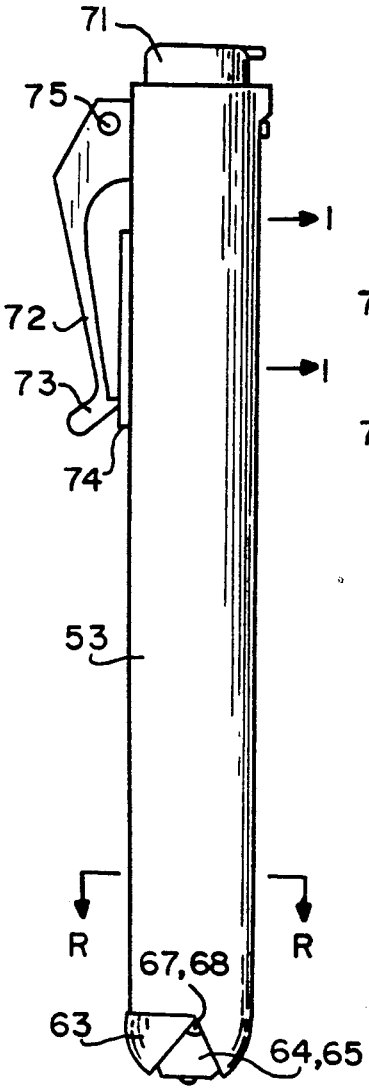
FIG. 18 is a side view of the FIG. 17 flashlight that shows the switch/pocket clip in the "OFF" position and the color filter in the "OFF" position.
Figure 19:
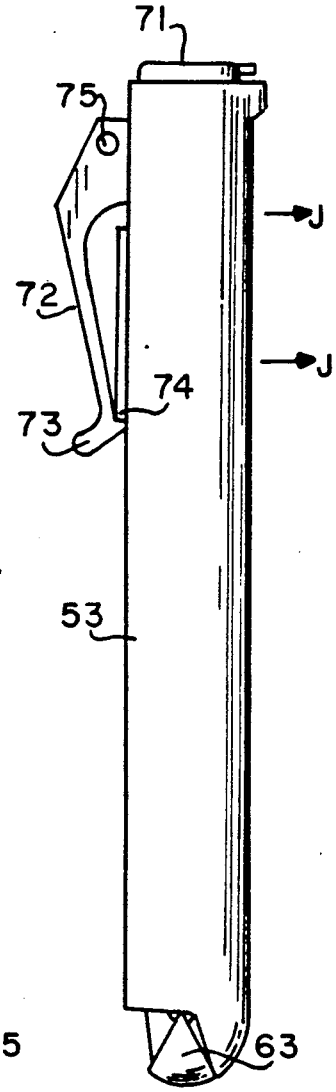
FIG. 19 is a side view of the FIG. 17 flashlight with the switch/pocket clip in the "ON" position and the filter in the "ON" position.
Figure 20:
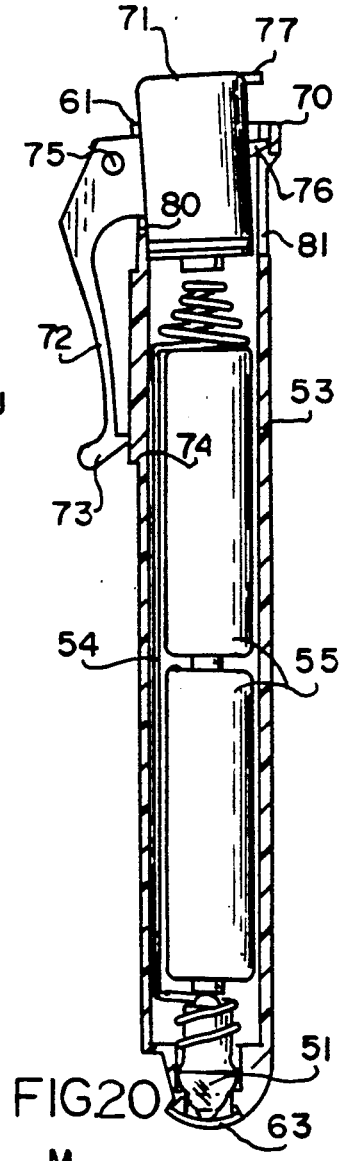
FIG. 20 is a sectional view through the flashlight taken along line K—K of FIG. 17. It shows the pocket clip being removed from the penlight.
Figure 28:
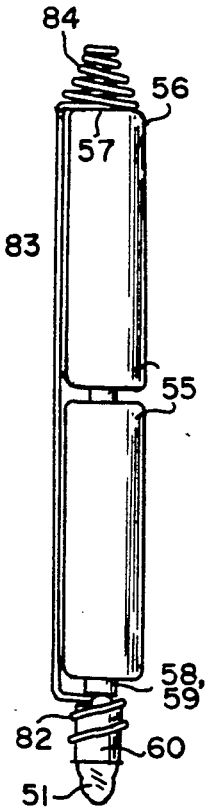
FIG. 28 is an illustration of the internal components as removed from the FIG. 21 flashlight.
Figure 32:
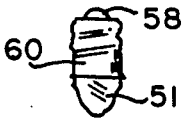
FIG. 32 is an elevation view of the lamp removed from the FIG. 28 assembly.
Figure 39:
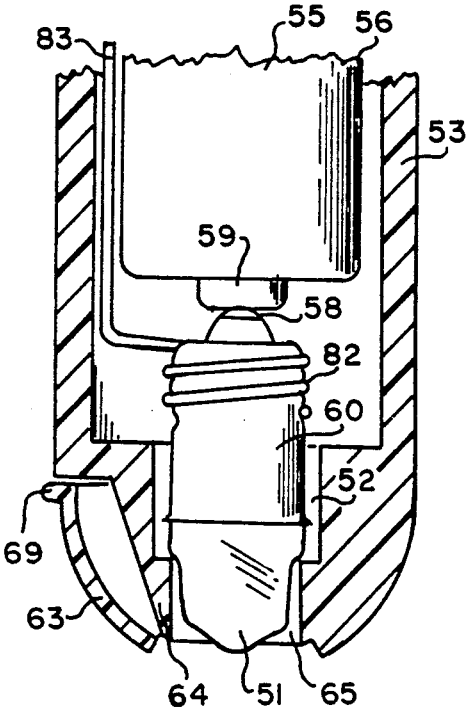
FIG. 39 is an expanded sectional illustration of the front of the flashlight taken on line R—R of FIG. 18 showing the filter retracted for projecting non-filtered light from the lamp bulb.

Inserted within the flashlight case 53 is a complete removable electrical subassembly shown separately in FIG. 28 and as placed in the case 53 in FIGS. 20–21. One or more batteries 55 (typically two in cascade) are provided with a positive battery terminal 59 making contact with the lamp bulb input terminal 58. A screw base return terminal 60 of the lamp bulb 51 is fitted tightly within a spiral spring portion 82 of the electrical conductor 54, shown typically in FIG. 29, which extends through a bridge segment 83 that passes between the interior surface of the case 53 and all of the included batteries 55 to terminate in a conically coiled helical spring 84. As detailed in FIGS. 36–37 the largest diameter coiled turn of the helical spring 84 rests upon the electrically insulated cover 56 of the last battery 55 contained in the case 53. The smallest diameter coiled turn of the helical spring 84 rests upon the inner end surface of the body 71 of the one-piece pocket clip and push button 61. When the user pushes the cylindrical body 71 of the push button 61 inward into the case 53 the helical spring 84 is compressed, FIG. 37, to collapse multiple progressively smaller turns of the spring 84 upon the base of the battery 55 which is its return negative electrical terminal 57, thus a complete electrical circuit is closed to activate the lamp 51 and projects light from the flashlight 50. When the heel 73 of the clip arm is released from the case switch retainer 74, FIGS. 18–19, the force of the helical spring 84 pushes the push button body 71 outward thereby lifting the multiple turns of the spring 84 from contact with the negative battery surface 57 opening the electrical circuit and turning the lamp bulb off.

The on-off switch of the flashlight 50 is embodied essentially within the contact of the helical spring 84 and the negative battery surface 57 as activated by the user through the pocket clip and push button 61 component. Thus the electrical circuit is reduced to its simplest form yet reliability and electrical efficiency are improved by the reduction in contact resistance as multiple turns of the coiled spring 84 collapse upon the battery return surface 57.

The bridging conductor 83 in simplest form is merely a linear portion of the wire that forms the spiral 82 and the conical helix 84 springs, however bridging conductor 83 may be shaped in the form of a flattened strap or more than one bridging conductor can be employed within the concept. It should be noted that the complete electrical subassembly as shown in FIG. 28 may be held externally to the flashlight case 53 in the hand of the user for test purposes. For example, thumb pressure upon the helical spring 84 can be applied to close the electrical circuit for testing the condition of the batteries 55 and the lamp bulb 51.

Modification of the embodiments of the invention shown and described herein may be made without deviating from their basic concepts and characteristics. The embodiments are therefore considered in all respects as illustrative and do not limit the scope of the invention indicated by appending claims.

Having described the invention, I claim:

1. A flashlight, which comprises:

a) a removably insertable light producing and electrical subsystem which comprises:

at least one dry cell battery that comprises an axial positive terminal at one end; a return negative surface at the opposing end; and an insulating cover surrounding the remaining body surface of said battery including an insulating strip contiguously upon the perimeter of said negative surface;

a lamp bulb comprising a base return terminal and an axial input terminal for continuous contact with said axial positive battery terminal;

a one-piece electrical conductor that comprises a lamp bulb base holding spring; a central segment for bridging across said insulating covers of all included batteries; and an on-off electrical switching spring for contacting said battery negative return surface for activating and extinguishing the light emission of said lamp bulb; and b) a mechanical structure for housing said insertable lighting and electrical subsystem which comprises:

a non-corrosive electrically insulating opaque tubular case for containing therein said light producing and electrical subsystem; said case comprising, at a front end thereof an internal axial holding cavity for said lamp bulb and a restrictive axial aperture for projection of light from said lamp bulb; an elongated central segment for housing said batteries and said one-piece electrical conductor; and an open end at the rear of said case for insertion and removal of said light producing and electrical subsystem;

a means for reversibly closing said open end at the rear of said case for holding the assembly of said light producing and electrical subsystem within said case and for operating said on-off electrical switching spring to activate and extinguish said projection of light from said lamp bulb in response to control by said user.

2. A flashlight, as recited in claim 4, wherein said on-off electrical switching spring comprises:

a) a conically coiled helix with a central axis of the coils offset to coincide with the longitudinal axis of said tubular case;

b) a first coiled turn of said helix extending from said central battery bridging segment of a diameter for closely fitting within the inner wall of said tubular case and of a diameter for abutting contact upon said perimeter insulating cover of said battery return surface;

c) a central segment of said helix comprising a multiplicity of successively smaller diameter coiled turns continuing from said first coiled turn, with the outside diameter of each successive coiled turn smaller than the inside diameter of the contiguous previous coiled turn for the progressive contact of said multiplicity of coiled turns upon said exposed negative battery return surface when compressive stress is applied by said user for switching said lamp bulb on and for switching said lamp bulb off when said compressive stress is removed; and d) a terminating coiled turn of said helix with a diameter at least equal to the diameter of the immediately preceding contiguous coiled turn for transmitting said compressive stress to said central segment of said helix.

3. A flashlight, as recited in claim 2, wherein said means for reversibly closing said open rear end of said case comprises:

a) a controller, operable by said user of said flashlight, comprising a body segment for insertion within said inner wall of said open rear end of said case to a depth sufficient for applying said compressive stress through contact with said terminating coil; and b) means, operable by said user, for effecting axial movement of said controller inward and outward within said case for applying said compressive stress to said switching spring.

4. A flashlight, as recited in claim 3, wherein said controller further comprises:

a) a pocket clip comprising a resilient flexible arm attached radially from said controller body segment and projecting longitudinally along the outer wall of said case; said clip arm terminating with a heel-like projection for latching said flashlight in a turned-on light projecting mode;

b) a retaining boss for securing said controller within said case;

c) a push button surface perpendicular to said longitudinal axis of said body segment for application of pressure, by the user, for said inward axial movement of said controller; and d) a contact surface perpendicular to said longitudinal axis opposite to said push button surface, said contact surface for compressing said switching spring.

5. A flashlight, as recited in claim 3, wherein said outward axial movement of said controller body segment is effected by said helical switching spring having the force of compressive stress stored in said multiplicity of coiled spring turns.

6. A flashlight, as recited in claim 4, wherein said controller still further comprises:

a) a circumferential groove about said body segment in proximity to said contact surface; and b) an O-ring assembled within said groove for sealing said case against entry of foreign particles and for water resistance of said flashlight.

7. A flashlight, as recited in claim 4, wherein said case still further comprises:

a) an open slot extending longitudinally inward from the peripheral edge of said rear end of said case for receiving said pocket clip;

b) a closed slot extending longitudinally inward from an interior location near said peripheral edge of said case rear end for a distance to accomodate said axial movement of said controller, said closed slot for receiving and securing said retaining boss; and c) a means for automatic latching of said clip heel-like projection to said case for locking said flashlight in said "ON" condition.

8. A flashlight, as recited in claim 7, wherein said pocket clip further comprises an offset extension of said flexible arm for application of manual force for releasing said latching heel-like projection for an "OFF" condition of said flashlight.

9. A flashlight, as recited in claim 7, wherein said controller still further comprises:

a) a second boss extending radially from said push button surface of said body segment for the manual application of angular force for flexing said case rear end for releasing said retaining boss from said closed slot for removal of said controller from said case and for access to said light producing and electrical subsystem for servicing.

10. A flashlight, as recited in claim 2, wherein said flashlight further comprises:

a) means for color filtering of said light projected from said restrictive axial aperture of the front end of said tubular case, operable by said flashlight user for selecting between unfiltered light of said lamp bulb and filtered light at a color of the visible light spectrum of colors.

11. A flashlight, as recited in claim 10, wherein said means for color filtering of said projected light comprises:

a) a translucent color filter of resilient flexible material comprising:

a sector of a spherical shell contained within an acute apex angle;

first and second stub axles projecting inward from opposing apexes of said sector for an axis of rotation of said color filter for selective covering of said light projecting aperture of the front end of said tubular case; and a raised lip at the rearward edge of said sector for manual application of torque, by said user, for rotating said filter about said stub axles; and b) said front end of the tubular flashlight case further comprising:

first and second recessed bearing surfaces diametrically opposed in the outer surface of said case front end located about an axis of rotation for said color filter that intersects and is perpendicular to said longitudinal axis of said flashlight, said recessed bearing surfaces for receiving therein said first and second filter stub axles, respectively, and a contoured exterior surface for a segment of said front end of the tubular case for matching the interior contours of said sectored color filter for preventing unfiltered lamp light from exiting said flashlight when said filter is positioned, by said operating user, for filtering and projection of said selected colored light.

* * * * *